United States Patent [19]

Frank

[11] Patent Number: 4,601,471

[45] Date of Patent: Jul. 22, 1986

[54] RANDOM NUMBER GENERATOR

[76] Inventor: Alan Frank, 5600 Munhall Rd., Pittsburgh, Pa. 15217

[21] Appl. No.: 751,689

[22] Filed: Jul. 3, 1985

[51] Int. Cl.[4] ..... A63F 7/00

[52] U.S. Cl. ..... 273/144 B; 366/101

[58] Field of Search ..... 273/144 B; 366/101, 366/106

[56] References Cited

U.S. PATENT DOCUMENTS

| | | | |
|---|---|---|---|
| 1,371,194 | 3/1921 | Bird | 273/144 B |
| 1,506,715 | 8/1924 | Ordway | 273/144 B |
| 1,602,358 | 10/1926 | Getskay . | |
| 2,103,151 | 12/1937 | Dietrich | 273/144 B X |
| 2,361,346 | 10/1944 | Atkins | 273/144 B UX |
| 2,385,980 | 10/1945 | Fostos | 273/144 B |
| 2,906,535 | 9/1959 | Hickey | 273/148 |
| 3,136,531 | 6/1964 | Wesselingh | 366/106 |
| 4,273,335 | 6/1981 | Allonsius | 273/144 B |
| 4,508,346 | 4/1985 | Salyucci | 273/144 B |
| 4,509,755 | 4/1985 | Cheatham | 273/144 B |

FOREIGN PATENT DOCUMENTS

| | | | |
|---|---|---|---|
| 552168 | 1/1958 | Canada | 273/144 B |
| WO84/00115 | 1/1984 | PCT Int'l Appl. | 273/144 B |

*Primary Examiner*—Paul E. Shapiro

*Attorney, Agent, or Firm*—Brady, O'Boyle & Gates

[57] ABSTRACT

A random number generating device for randomly selecting one of a plurality of suspendable balls which are stirred and circulated in a chamber by an upflowing fluid stream. Upon termination of fluid flow one of the balls falls downwardly through a relatively narrow bottom trough into a lower pocket having a transparent wall. The device is provided with steeply sloping inclined facing sidewalls flaring outwardly from said trough and sufficiently steep so that upon termination of fluid flow non-selected balls are out of contact with the selected ball as it falls from the trough into the pocket. Thereby, any jamming of non-selected balls occurs at an elevated level and does not prevent a single, randomly selected ball from entering the pocket at the end of each cycle.

14 Claims, 5 Drawing Figures

RANDOM NUMBER GENERATOR

This invention relates to a random number generating device.

Devices for randomly generating a number by mixing balls wherein the random mixing motion is visable and wherein the devices are operable without human contact or assistance are not presently available. Existing devices for stirring a plurality of balls which can be suspended in an air stream for the purpose of randomly selecting one or more balls have certain disadvantages. Generally, existing devices require an attendant to help retrieve the randomly selected ball. They usually involve removal of the selected ball from the device or attendant handling of the selected ball. Unattended devices have the disadvantage of frequently jamming, often preventing selection of a single ball in every operating cycle. Also, some unattended devices do not allow the randomly selected balls to remain observable in their selection location for a sufficient length of time. All of these disadvantages are obviated in the device of the present invention.

In accordance with the present invention, one or more transparent chambers having facing sidewalls inclined outwardly from opposite sides of a lower trough or channel are supplied with a plurality of lightweight, suspendable, ping-pong-type balls. The balls are indicia marked. For example, single digits from zero to nine can be printed on each ball. For convenience, each digit can be printed up to six times or more on each ball. Any other indicia or any color marking can be used.

Preferably, there is no opening in the chamber enclosing the balls sufficiently large to remove the balls. The balls can be thereby effectively sealed within the chamber. The facing inclined sidewalls are disposed at an intermediate height in the chamber and flare outwardly from the sides of an elongated trough on a lower level. The trough is provided with a floor or ramp which is preferably sloped downwardly from rear to front. The forward end of the trough exits into a transparent pocket just large enough to permit a single ball to fall in. Individual balls approach the pocket by moving along the ramp of the trough and then fall into the pocket.

A portion of the floor of the pocket is open and constitutes a fluid inlet passageway. Fluid is moved upwardly through this passageway. Balls caught in the stream float upwardly at the front of the chamber towards a deflecting wall at an upper level. Balls hitting the deflecting wall are deflected towards the rear of the chamber. A discharge opening preferably at the upper rear of the chamber further encourages circulating movement of the balls. However, the discharge opening can be at any convenient location in the chamber.

Preferably, the pocket serves as the only entrance for the entering fluid stream. The height of the pocket need only be slightly greater than the diameter of a ball. The bottom of the pocket is equipped with a shelf, which can be horizontal, which prevents a ball from dropping out of the pocket and which partially closes the fluid inlet passageway.

An external fluid pump is associated with the fluid inlet opening at the bottom of the pocket by means of a connecting conduit, plenum or chamber. Fluid entering the chamber from the pump stirs the balls. Construction features of the pocket encourage formation of a reduced pressure zone within the pocket to ensure the presence of a randomly selected ball in the pocket at the cessation of fluid flow.

This invention is illustrated in the accompanying drawings in which.

Figure 1:
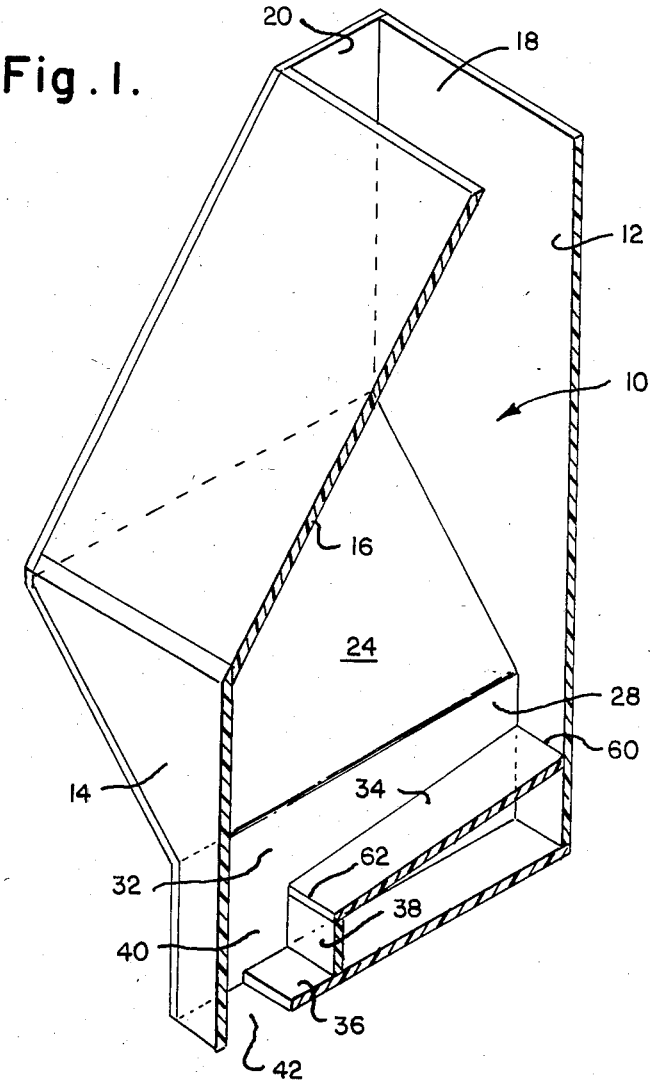
FIG. 1 is a mid-section cutaway isometric view of a random number selector chamber for balls.
Figure 4:
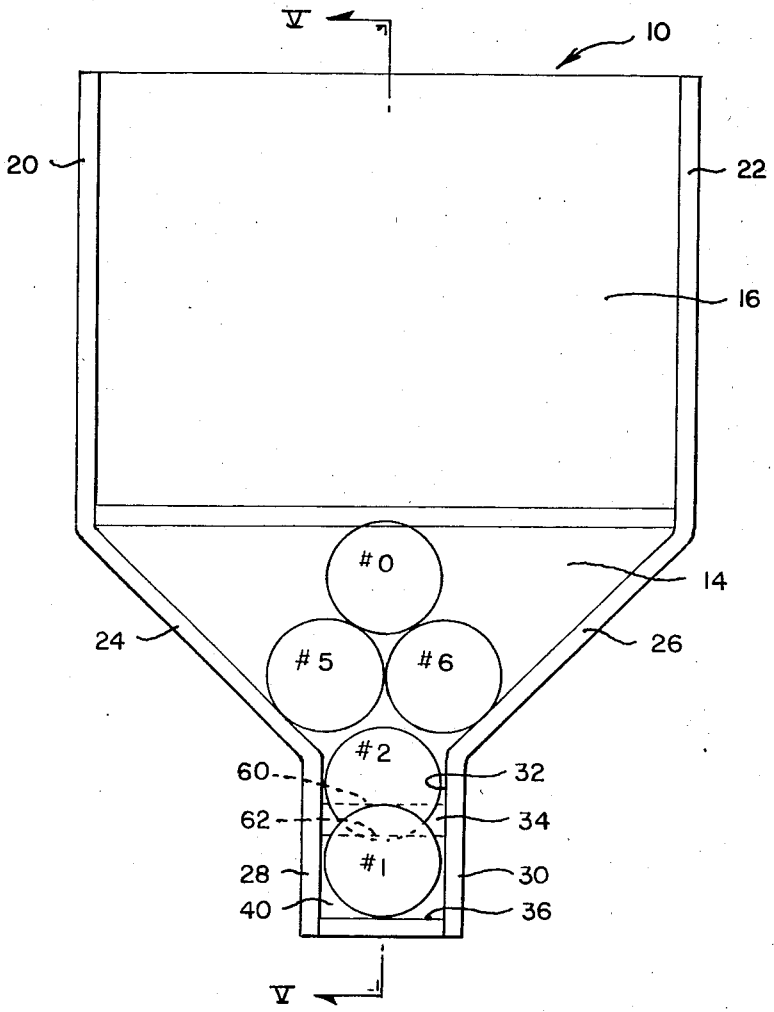
FIG. 4 is a front view of the chamber with a view of indicia-marked balls upon termination of fluid flow.

Referring to FIGS. 1 and 4, chamber 10 can comprise transparent plastic or glass for all parts and includes rear wall 12 and front wall 14. Deflector wall member 16 is located at the upper region of the interior of chamber 10 and is sloped sharply upwardly from front to rear to partially define a fluid exhaust port 18 at the top rear of the chamber. Exhaust port 18 is defined by deflector wall 16, rear wall 12, a first upper side wall 20 and a second upper side wall 22.

The middle region of chamber 10 is defined by rear wall 12, front wall 14 and by facing inclined sidewalls 24 and 26 which are sharply sloped inwardly from top to bottom. The bottom region of chamber 10 is defined by rear wall 12, front wall 14 and by vertical facing walls 28 and 30. The bottom region of the chamber comprises a relatively narrow trough or valley 32 whose sides abut with sloping inclined walls 24 and 26.

Trough 32 is provided with a floor or ramp member 34 which is tilted downwardly from rear to front. The front of ramp 34 is provided with a shelf 36 which is connected to ramp 34 by vertical step-down member 38. Shelf 36, step-down member 38, facing walls 28 and 30 and front wall 14 define a pocket 40 having a bottom partial opening 42 to define a fluid inlet passageway.

Figure 2:
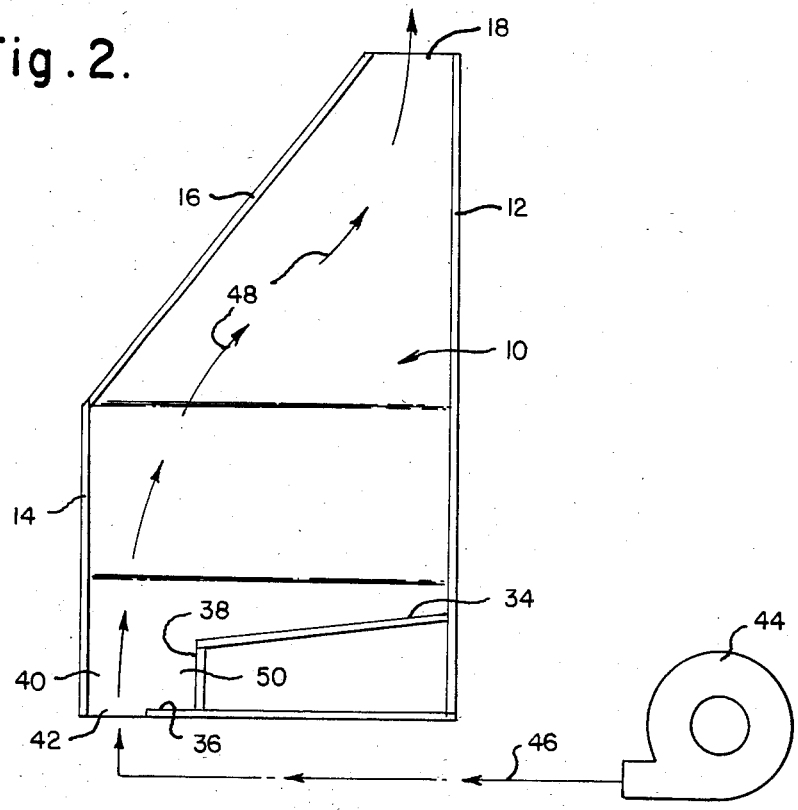
FIG. 2 is a side view of the chamber in arrangement with a fluid pump, indicating the flow of fluid through the chamber.
Figure 3:
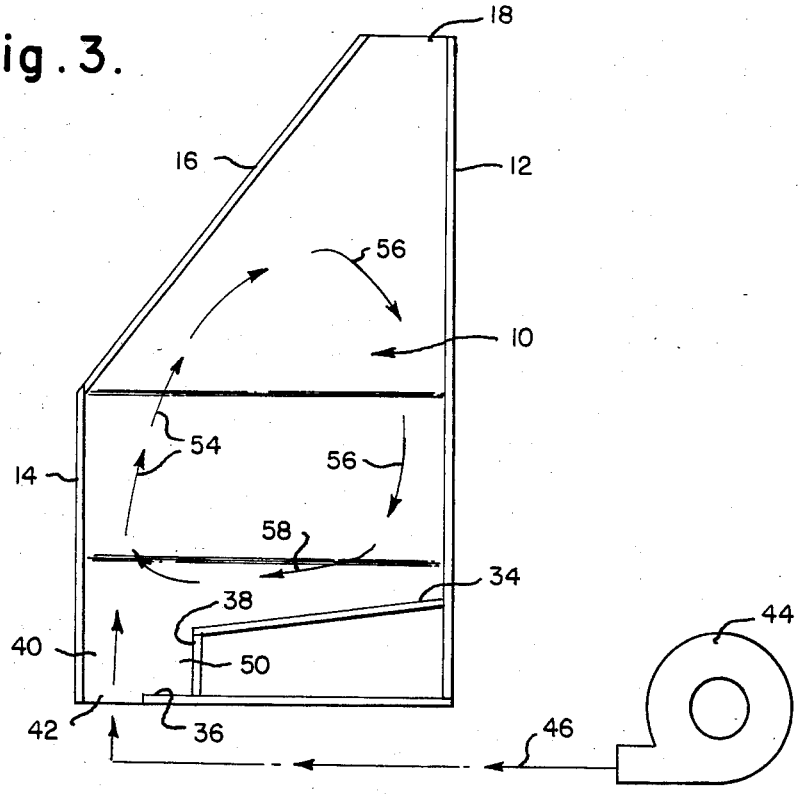
FIG. 3 is a side view of the chamber in arrangement with a fluid pump, indicating the generalized circulation of indicia-bearing balls under the influence of fluid flow.

FIGS. 2 and 3 illustrate chamber 10 in association with fluid pump 44 and a fluid conduit figuratively shown at 46 for supplying fluid from pump 44 to fluid opening 42. Fluid is pumped through opening 42 and upwardly through chamber 10 and discharges through top opening 18. The generalized path of fluid flow is indicated by arrows 48 in FIG. 2. In the preferred embodiment, the fluid is air and the pump is a blower. However, oil or water can be used as fluids, in which case a liquid pump is employed.

Enclosed localized region 50 of pocket 40 is lateral to and out of the direct path of the relatively high velocity fluid inflow stream entering through passageway 42. Thereby, region 50 is subjected to an aspiration effect in relationship to ramp 34 which tends to draw any ball near the bottom end of ramp 34 toward it. Thereby, any ball on ramp 34 will tend to move downwardly both by force of gravity and also by the aspiration effect at zone 50. These two forces tend to ensure the presence of a single randomly selected ball in pocket 40 at the end of a cycle.

The circulation of balls is illustrated by the arrows in FIG. 3. A ball in pocket 40 and balls resting on facing sidewalls 24 and 26 are blown upwardly as noted by arrows 54. As a ball rises it will be deflected rearwardly by deflector wall 16 and tend to fall by gravity, as indicated by arrows 56. When a ball reaches ramp 34 it will not only tend to move or roll downwardly under the influence of gravity but it will also be drawn downwardly along ramp 34 into pocket 40 by means of the aspiration effect at zone 50 in pocket 40, as indicated by arrows 58. After a ball falls into pocket 40 it will be immediately lifted by the incoming fluid stream as indicated by arrow 54 to repeat the cycle.

The aspiration effect at zone 50 provides a continuous positive force, in addition to gravity, to draw a ball into pocket 40. Gravity alone will cause frequent jamming of the front-back and lateral variety. Pocket 40 is only sufficiently large to contain a single ball. The aspiration effect overcomes the gravity-caused jamming which otherwise could block a ball from entering pocket 40 and thereby prevent random selection of a single ball. It was found that when shelf 36 was replaced by a needle of sufficient strength to support a ball, the incidence of such jamming increased markedly. It will be appreciated that the replacement of shelf 36 by a needle opens zone 50 to different incoming fluid flow patterns and prevents establishment of the aspiration effect. Therefore, the presence of shelf 36 to partially enclose opening 42 and the establishment of aspiration zone 50 in pocket 40 to create aspiration relative to ramp 34 is an anti-jamming feature and essentially ensures the presence of a single randomly selected ball in pocket 40.

Figure 5:
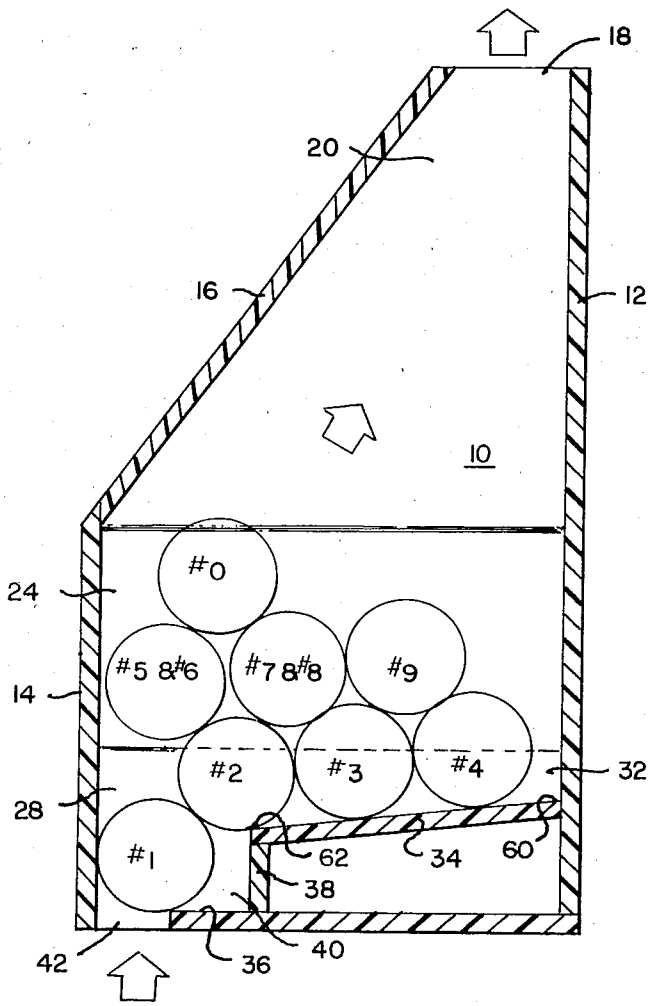
FIG. 5 is a side cross-sectional view of the chamber with a view of indicia-marked balls upon termination of fluid flow.

The depth of trough 32 at the front edge of ramp 34 is important in relationship to the slope of inclined facing sidewalls 24 and 26 and the size of the balls. The interrelationship of all these dimensions is established to provide a clearance space between a ball moving off the front end of ramp 34 into pocket 40 and any balls immediately overhead resting upon inclined sidewalls 24 and 26. Referring to FIGS. 4 and 5, the rear end of ramp 34 is indicated at 60 and the front end at 62. FIG. 4 shows a ball marked as #2 tending to fall from front end 62 into pocket 40. FIG. 4 shows that trough 32 is sufficiently deep at front end 62 to provide a clearance between ball #2 and overhead jammed non-selected balls #5 and #6. Therefore, ball #2 is free to flow under any overhead bridge of balls #5 and #6 and ball #2 is sure to fall into pocket 40.

Referring to FIG. 4, the slope of sidewalls 24 and 26 cooperates with the depth of trough 32. As walls 24 and 26 become increasingly steep, balls #5 and #6 are progressively lifted out of contact with ball #2 to help establish a clearance between randomly selected ball #2 and non-selected balls #5 and #6 to encourage dropping of ball #2 into pocket 40, if pocket 40 is otherwise empty. As walls 24 and 26 decrease in steepness from the vertical, bouncing and mixing are enhanced. In the preferred embodiment a slope of about 45° created best mixing.

A plurality of the devices described herein can be arranged in side-by-side relationship so that the random number generated will be a series of the single digits generated in the individual devices.

I claim:

1. A random ball selector device comprising a chamber for mixing balls, said chamber having inlet opening means in the region of the bottom thereof for the admission of a fluid stream and separate discharge opening means for the discharge of said fluid stream, the lower region of said chamber comprising a trough means extending from the rear to the front of said chamber, ramp means within said trough means, pocket means at the front of said ramp means for receiving a randomly selected ball from said ramp means, said inlet opening means being near the bottom of said pocket means, partial enclosure means adjacent to said opening means and near the bottom of said pocket means for creating aspiration relative to said ramp means, inclined facing sidewall means defining said chamber and sloping upwardly and outwardly from said trough means, the depth of said trough means and the slope of said inclined facing sidewall means being adapted to permit a randomly selected ball to move from said ramp means into said pocket means underneath non-selected balls positioned along said inclined facing sidewall means upon cessation of said fluid stream.

2. The random ball selector device of claim 1 including a fluid pumping device for pumping fluid through said bottom opening means.

3. The random ball selector device of claim 1 including a plurality of indicia-marked balls.

4. The random ball selector device of claim 1 including a plurality of indicia-marked balls, said balls being larger than any opening of said device.

5. The random ball selector device of claim 1 including an inclined deflecting wall in the upper region of said chamber for deflecting circulating balls from the front to the rear of said chamber.

6. The random ball selector device of claim 1 comprised of a transparent material.

7. The random ball selector device of claim 1 wherein said discharge opening means is at the top region of said chamber.

8. The random ball selector device of claim 1 wherein said discharge opening means is at the top and rear region of said chamber.

9. The random ball selector device of claim 1 wherein said facing inclined sidewalls are each inclined at an angle of about 45°.

10. The random ball selector device of claim 1 wherein said ramp means is inclined.

11. The random ball selector device of claim 1 wherein said ramp means is inclined downwardly from the rear to the front of said chamber.

12. The random ball selector device of claim 1 wherein said pocket means is at least partially below said ramp means.

13. The random ball selector device of claim 1 wherein said partial enclosure means is located between said inlet opening means and said ramp means.

14. A plurality of random ball selector devices as described in claim 1 arranged in side-by-side relationship.

* * * * *